US006965325B2

(12) United States Patent
Finnern

(10) Patent No.: US 6,965,325 B2
(45) Date of Patent: Nov. 15, 2005

(54) TRAFFIC MONITORING SYSTEM

(75) Inventor: Mark Finnern, San Francisco, CA (US)

(73) Assignee: SAP Aktiengesellschaft, Walldorf (DE)

( * ) Notice: Subject to any disclaimer, the term of this patent is extended or adjusted under 35 U.S.C. 154(b) by 22 days.

(21) Appl. No.: 10/441,860

(22) Filed: May 19, 2003

(65) Prior Publication Data

US 2004/0233070 A1 Nov. 25, 2004

(51) Int. Cl.[7] ..... G08G 1/123

(52) U.S. Cl. ..... 340/995.23; 340/995.17; 340/995.19

(58) Field of Search ..... 340/936, 991, 340/995.19, 995.23, 995.27, 905, 933, 937, 988, 990, 995.1, 995.13, 995.14, 995.17; 701/208, 209, 117, 200

(56) References Cited

U.S. PATENT DOCUMENTS

| | | | | |
|---|---|---|---|---|
| 5,699,056 A | * | 12/1997 | Yoshida | 340/905 |
| 6,124,810 A | * | 9/2000 | Segal et al. | 340/994 |
| 6,381,533 B1 | | 4/2002 | Crane et al. | 340/988 |
| 6,480,783 B1 | * | 11/2002 | Myr | 701/117 |
| 6,487,497 B2 | | 11/2002 | Khavakh et al. | 701/209 |
| 6,507,850 B1 | | 1/2003 | Livshutz et al. | 701/104.1 |
| 6,539,302 B1 | | 3/2003 | Bender et al. | 340/905 |
| 6,614,363 B1 | | 9/2003 | Behr et al. | 340/995.1 |
| 6,650,995 B2 | * | 11/2003 | Bullock | 701/117 |
| 6,741,932 B1 | | 5/2004 | Groth et al. | 701/210 |
| 6,801,850 B1 | * | 10/2004 | Wolfson | 701/209 |
| 6,823,257 B2 | | 11/2004 | Clapper | 701/207 |

FOREIGN PATENT DOCUMENTS

EP 1004852 A2 5/2000

* cited by examiner

*Primary Examiner*—Van T. Trieu
(74) *Attorney, Agent, or Firm*—Fish & Richardson P.C.

(57) ABSTRACT

Systems and techniques to determine a primary route between two locations by monitor vehicle speed using transmitting wireless devices. In general, in one implementation, the technique includes: receiving information associated with traffic conditions on a route from a starting location to a destination location; determining a primary route from the starting location to the destination location; determining an average speed of vehicles along portions of the primary route from signals received from wireless transmitters transmitting from the vehicles; identifying one or more delayed portions of the primary route at which the average speed is less than a respective predetermined speed; and displaying the primary route including indicia of the one or more identified delayed portions. The wireless device may include a cellular phone and a personal digital assistant.

52 Claims, 11 Drawing Sheets

600

602 604 606 608 610

| Wireless ID | T5 | T6 | T7 | |
|---|---|---|---|---|
| 01 | 10:12:01 | 10:13:07 | 10:15:12 | |
| 02 | 10:12:26 | 10:13:40 | 10:15:50 | |
| 03 | 10:15:10 | 10:14:07 | 10:11:55 | |
| 04 | 10:13:30 | 10:14:27 | 10:16:40 | |
| 05 | 10:18:40 | 10:17:38 | 10:15:30 | |
| 06 | 10:13:30 | 10:14:45 | | |
| 07 | 10:14:20 | 10:15:30 | 10:17:40 | |
| 08 | | 10:16:10 | 10:14:10 | |
| | | | | |

FIG. 6

TRAFFIC MONITORING SYSTEM

BACKGROUND

The present application relates to systems and techniques for monitoring traffic conditions on a route between locations.

Traffic conditions on roadways are commonly monitored in many cities, towns and areas. Information on the traffic flow may be gathered and monitored by methods including observation from helicopters or airplanes aloft for that purpose, personal reports of vehicle drivers and pedestrians, and roadway surveillance cameras. Information that affects traffic flow including weather conditions, roadway surface conditions, construction sites and accidents also may be gathered from public resources. The information may be relayed to the public through sources including media outlets, such as radio and television, and Internet websites and other networked sources, and newspapers.

A vehicle driver may determine a route from a starting location to a destination location by consulting on-line mapping systems. These mapping systems may enable a user to specify a starting location and a destination location and provide mapping of a route between those locations. The mapping system also may enable a user to specify user preferences for the mapping provided including shortest distance, shortest time, or scenic value. The mapping system also may provide a approximate driving time based upon factors such as distance and estimated traveling speed.

SUMMARY OF THE INVENTION

The following describes systems and techniques for providing a driving route from a starting location to a destination location including, for example, information on traffic conditions along the route.

In general, in one aspect, monitoring traffic conditions along a route between a starting location and a destination location is facilitated by determining a primary route from the starting location to the destination location and determining an average speed of vehicles along portions of the primary route from signals received from wireless transmitters transmitting from the vehicles. One or more delayed portions of the primary route are identified at which the average speed is less than a respective predetermined speed. The primary route is displayed including indicia of the one or more identified delayed portions.

The identifying of a delayed portion of the route may be facilitated by determining an initial time when a signal from each of a plurality of transmitters transmitting from vehicles traveling along the primary route is received by a first receiver having a known reception area; determining a final time when each of transmitters is no longer received by the first receiver; calculating the speed of each of the transmitters through the first reception area; combining the speeds of all transmitters in the series; and determining a delayed portion based upon a comparison of the combined speed with an predetermined speed.

The wireless transmitting device may be a cellular phone or a personal digital assistant (PDA) or a transmitter mounted in the vehicle.

In another aspect, determining the speed of vehicles along a route is facilitated by determining a first location of a wireless transmitter transmitting from a vehicle traveling along a route relative to a first receiver at a first time based on a first signal received from the transmitter; determining a second location of the transmitter relative to the first receiver at a second time based on a second signal received from the transmitter; calculating a distance between the first and second locations; and calculating a speed of the transmitter.

Other aspects include an article comprising a machine-readable medium storing machine-readable instructions that, when executed, cause a machine to perform the disclosed techniques, and/or a system that includes one or more computers configured to implement the disclosed techniques.

The systems and techniques described here may provide one or more of the following advantages. In some implementations, the techniques may used to enable a user to select a route from a source to a destination based upon current conditions along a system-provided route. The techniques also may have the advantage of providing information on the current speed of vehicles along portions of system-provided route. In various implementations, the system enables a user to specify a default value for a starting location and for a destination location. These specified default values may be used by the system to provide a may route map for routes often traveled by the user.

Details of one or more implementations are set forth in the accompanying drawings and the description below. Other features and advantages may be apparent from the description and drawings, and from the claims.

BRIEF DESCRIPTION OF THE DRAWINGS

These and other aspects will now be described in detail with reference to the following drawings.

FIG. 6 is a sample matrix of times that transmitted signals from wireless transmitters are received at example receivers.

Like reference numbers and designations in the various drawings indicate like elements.

DETAILED DESCRIPTION

The systems and techniques described here relate to monitoring traffic conditions on a predetermined route. A portable wireless web access device may be used to monitoring traffic conditions substantially in real time based on input from multiple disparate information sources. A user device, for example, a including handheld device such as a Personal Digital Assistant (PDA) or a cellular phone may be used to display a route from a starting location to a destination location. The system may have indicia for portions of the route that have traffic delays. A delayed portion of the route is deemed to be one where the traffic is moving at a speed less than a predetermined speed. Links may be provided to a textual description of the delay or traffic camera pictures of a delayed portion of the route.

In another aspect, techniques are disclosed for determining route delay portions by monitoring the progress of transmitting locations of wireless communication devices along the route. The speed of progress of the transmitting location is used as a proxy for the actual speed of the vehicular traffic in the route portion. The actual speed is compared to a predetermined speed to determine whether traffic is delayed in that portion of the route.

Figure 1:
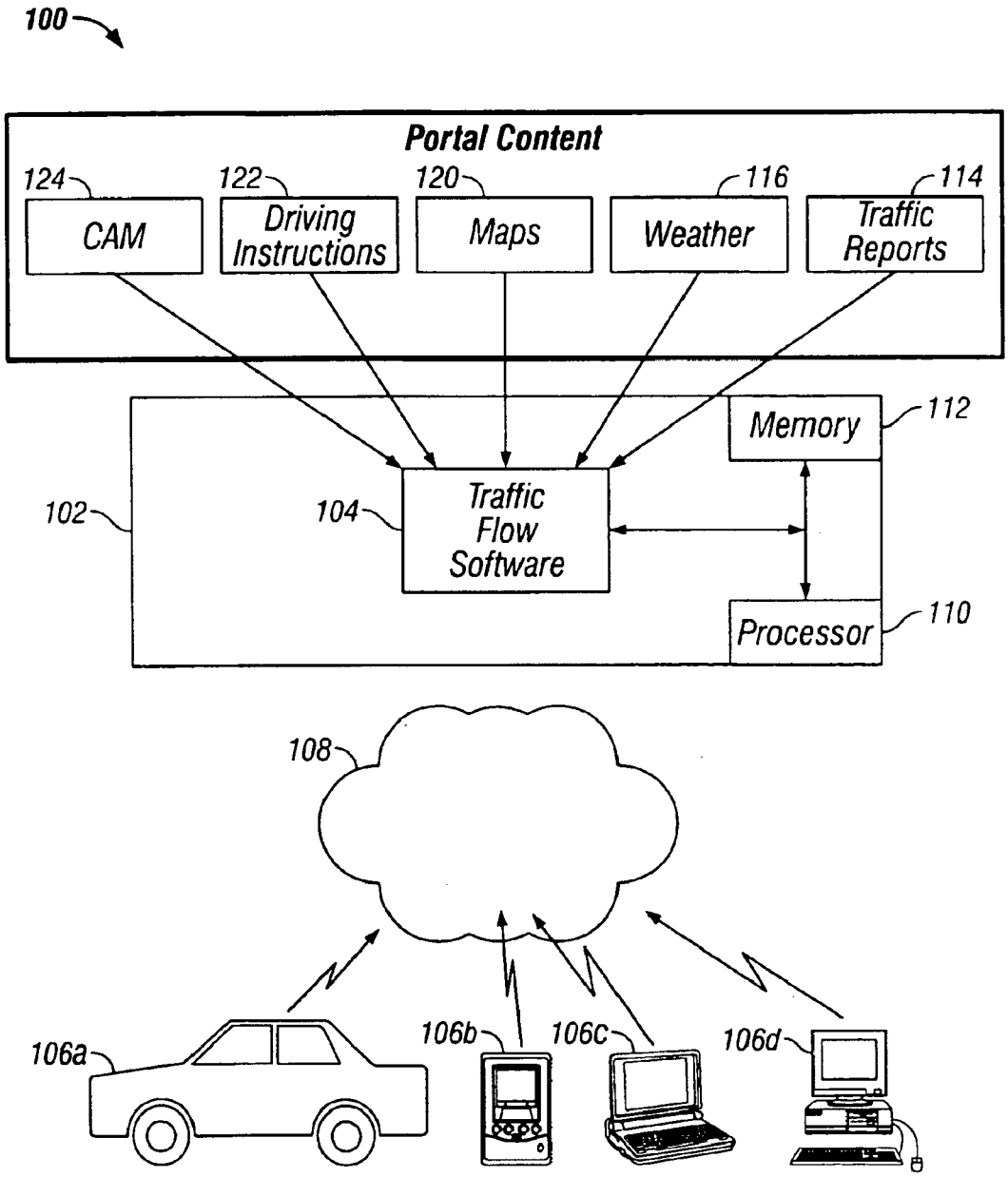
FIG. 1 is a block diagram illustrating a traffic monitoring system.

FIG. 1 illustrates a block diagram of a computer system that may be used to implement a traffic monitoring system 100. The system includes a host server 102 including interface software operating traffic flow software 104 that may accessed by a user device including a vehicle global positioning system (GPS) 106*a*, a personal digital assistant (PDA) 106*b*, a cellular phone 106*c*, a personal computer (PC) 106*d* or virtually any other device using wireless or wired communication protocols to access the host server 102 over a network 108.

In an implementation, the traffic flow software 104 can present a user with a display of a traffic route from a starting location to a destination location. The display may sized to be shown on the screens of the devices 106 and may be tailored to known characteristics of the user. The default starting and destination locations may be determined by, for example, the host server knowing the home address and work address of the user. In another implementation, the user may select a desired starting location, or destination location, or select from among alternative routes between the starting location and the destination location. The traffic flow software 104 may provide a user with access to network-based resources related to driving conditions along a selected route. For example, the system may present the user with information network resources including traffic reports 114, weather reports 116, route maps 120 from starting to destination location, driving instructions 122 and real-time camera views 124 of the route.

The host server 102 may include, for example, a processor 110 and a memory 112. The memory 112 may be configured to include a database for use by the host server 102 to store and retrieve information related to the operation of the host server 102 including execution of the traffic flow software 104 to present the display to the user. The host server 102 may receive information from available resources on the network 108 and provide a user environment with selected access to the resources. The available resources may include documents, files, or other structured or unstructured information. The memory 112 may be used to operate on input requests received from a user and to display or otherwise provide output associated with the user requests. The network 108 may include a plurality of devices such as servers, routers and switching elements connected in an intranet, extranet or Internet configuration.

Figure 2:
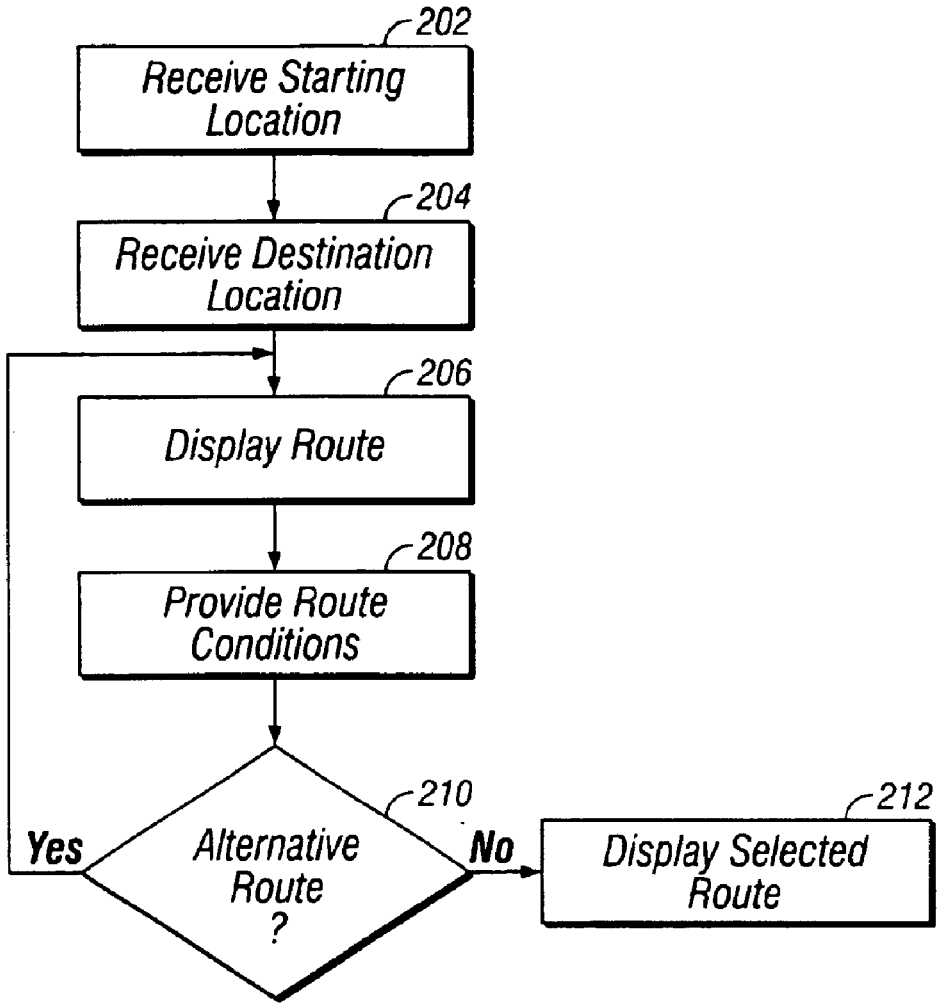
FIG. 2 is a flow chart of a process for implementing a traffic monitoring system.

FIG. 2 is a flow chart 200 of an implementation of a traffic monitoring system. The system receives 202 a starting location from a user of the system. The system may offer a default starting location, for example, the user's home address, which the user may change. In that case, the changed starting location may be used by the system as a new stored default starting location, stored on a list of previously selected starting locations or used for one route determination and discarded. In an implementation, the system may determine a starting location from a location received from a global positioning system (GPS) associated with the transmitter. Similarly, the system receives 204 a destination location from a user of the system. The system may offer a default destination location, for example the user's work address, which the user may change. The changed destination location may be used by the system as a new stored default destination location, stored on a list of previously selected destination locations or used for one route determination and discarded.

The traffic monitoring system displays 206 a primary route from the starting location to the destination location. The system may locate the primary route by accessing network structured and unstructured resources and providing the content in a size suitable for display on an output device such as a PDA or cellular phone. The system may access additional structured and unstructured network resources to provide 208 route condition information on the primary route. The route condition information may include weather conditions, accident reports and traffic delays. Indicia of route condition information may be provided at associated delay portions of the displayed route.

The traffic monitoring system may display an alternative route from the starting location to the destination location in response to a user request 210. The search for an alternative route also may be triggered by delays on the primary route. The user may be warned of traffic delays and the alternative route may be offered. If an alternative is requested, the system displays 206 the alternative route and provides 208 route condition information. If an alternative route is not requested 210, the traffic monitoring system displays the user-selected route 212 and may further include driving instructions for navigating from the starting location to the destination location. In an implementation, the system may automatically monitor conditions along selected route at a predetermined interval. The system may provide an alternative route in response to changes in traffic conditions along the selected route.

Figure 3A:
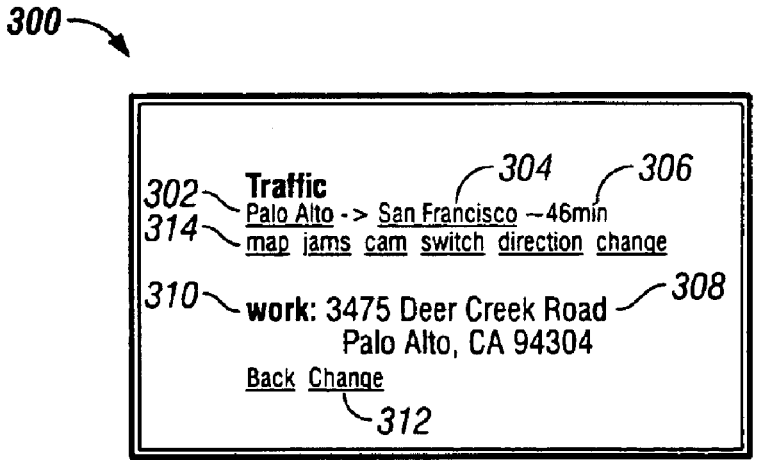
FIGS. 3A–3I are display screens associated with an implementation of a traffic monitoring system.

FIGS. 3A–3I illustrate displays of an implementation of a traffic monitoring system. FIG. 3A illustrates a starting location display 300 that may be displayed on a user's wired or wireless device. In one implementation, the display 300 shows a starting location 302, a destination location 304 and an estimated driving time 306. The starting and destination locations may have default values previously selected by the user. The system also may display a detailed address 308 of the starting location, which may be associated with a starting location nominative title 310. The display 300 also may include a menu 314 that provides one or more selections to link to content from other network sources. The menu may include, for example: (1) a "map" selection to provide a link to a route map, for drawing a map between a starting and a destination location. The map may include indicia of delay portions; a jams button to provide details of a delay in a portion of a route displayed on the map, (2) a "cam" or "camera" selection to provide access to available live traffic cameras on the chosen route, (3) a "switch" selection, to switch around the starting location and destination location and calculate route and travel time, (4) a "direction" selection to determine alternative routes, and (5) a "change" selection to change the addresses associated with the starting or destination location.

Figure 3B:
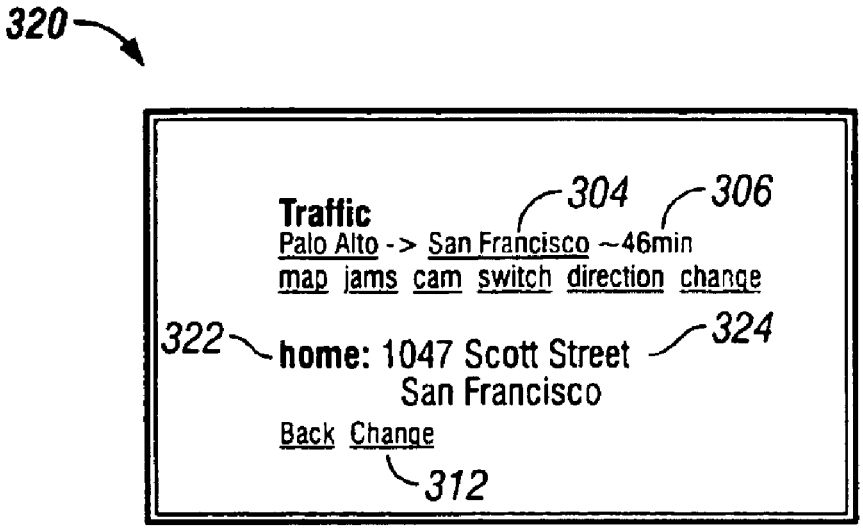

FIG. 3B illustrates a destination location display 320 that may be displayed for the destination address 304. The destination address 324 stored in system memory may be displayed along with the destination location nominative title 322.

Figure 3C:
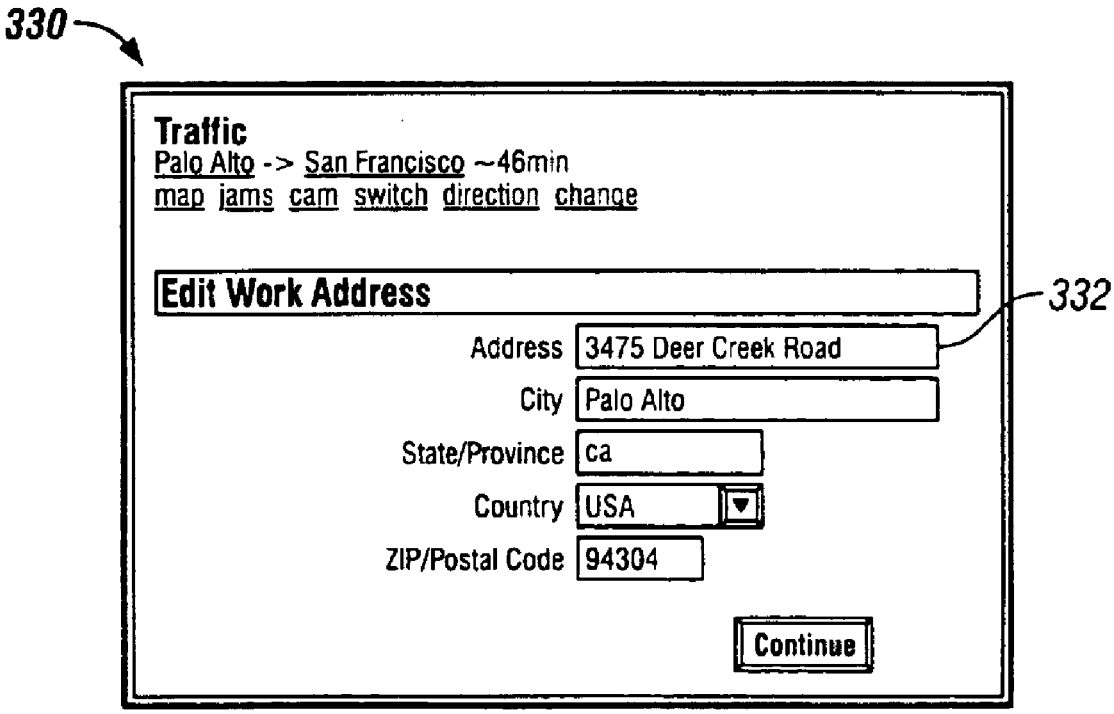

FIG. 3C illustrates an implementation of a traffic monitoring system address editing display 330 that may be displayed in response to a user selecting the change address button 312. The current address 332 may be displayed and edited by the user. The system may be enabled to store the change as a temporary address or as a new default location address.

Figure 3D:
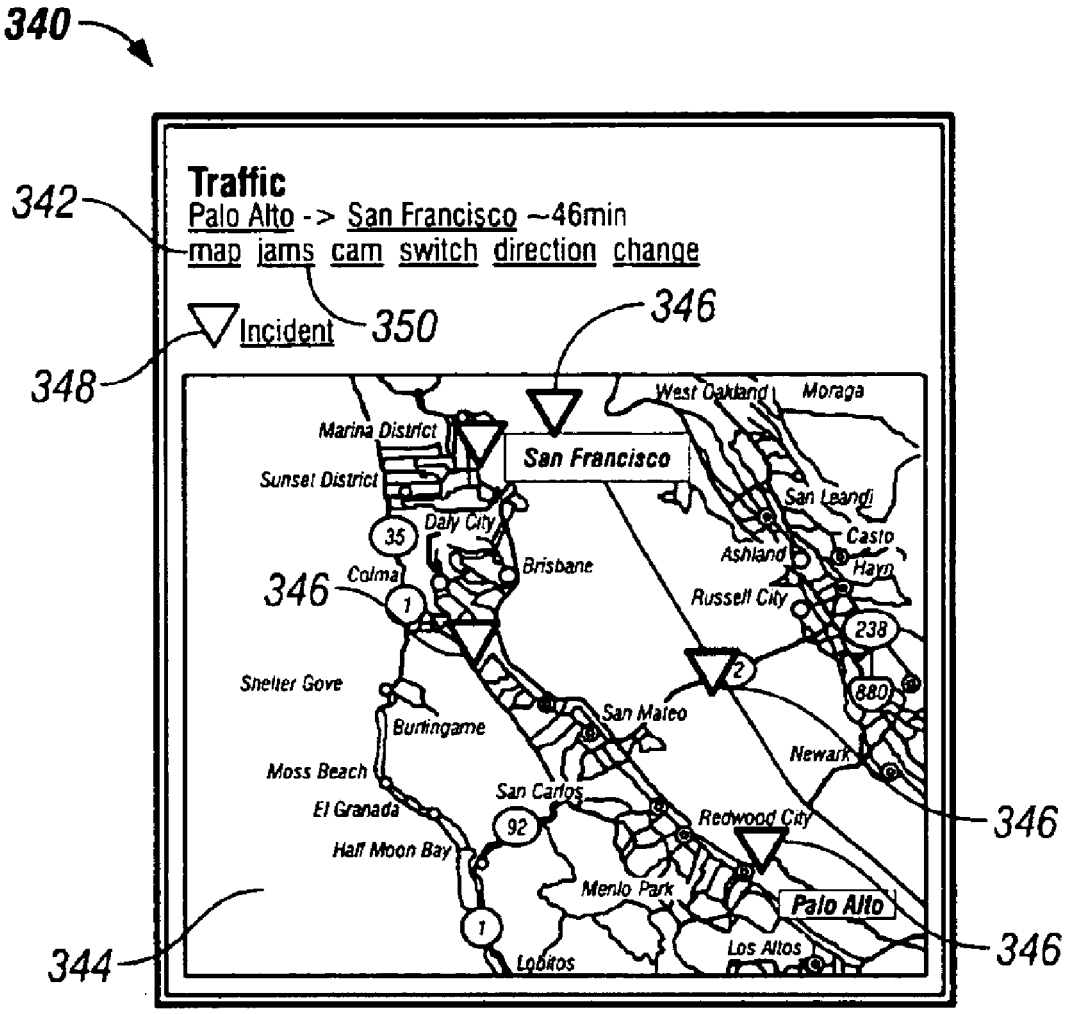

FIG. 3D illustrates an implementation of a map display 340 that may be provided by the traffic monitoring system in response to a user selection of a map button 342. A map 344 may be displayed showing the route from the starting location to the destination location. The map 344 may be retrieved from network-based resources. The traffic monitoring system also may retrieve information on reported traffic delays and obstruction from network-based resources. The system may use the information on delays and obstructions to provide indicia 346 on portions of the map at the location of the reported traffic delays. Each respective indicium 346 also may be selectable and linked to details of the respective traffic delay or obstruction. The map display 340 also may include a selectable incident icon 348 or jams button 350 that is linked to a listing of all reported traffic delays and obstructions.

Figure 3E:
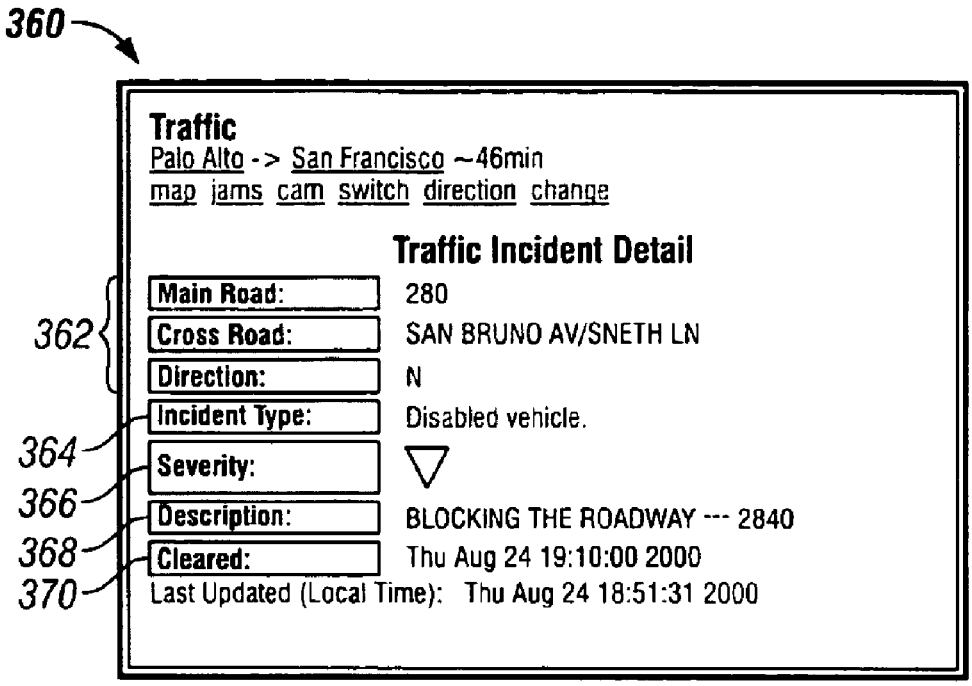

FIG. 3E illustrates an implementation of an incident detail display 360 that may be provided by the traffic monitoring system in response to the user selecting an indicium 346. The display 360 may provide detailed information related to the indicium selected including a specific location of the traffic incident 362 and an incident type 364 such as "disabled vehicle" or "icy conditions," for example. The incident detail display 360 also may provide a severity indicator 366 that is indicative of relative level of traffic disruption such as a numeric or color-coded indication. The display 360 also may include a short narrative description 368 of the incident and a cleared notification 370 indicating when the incident was cleared from the route, if available.

Figure 3F:
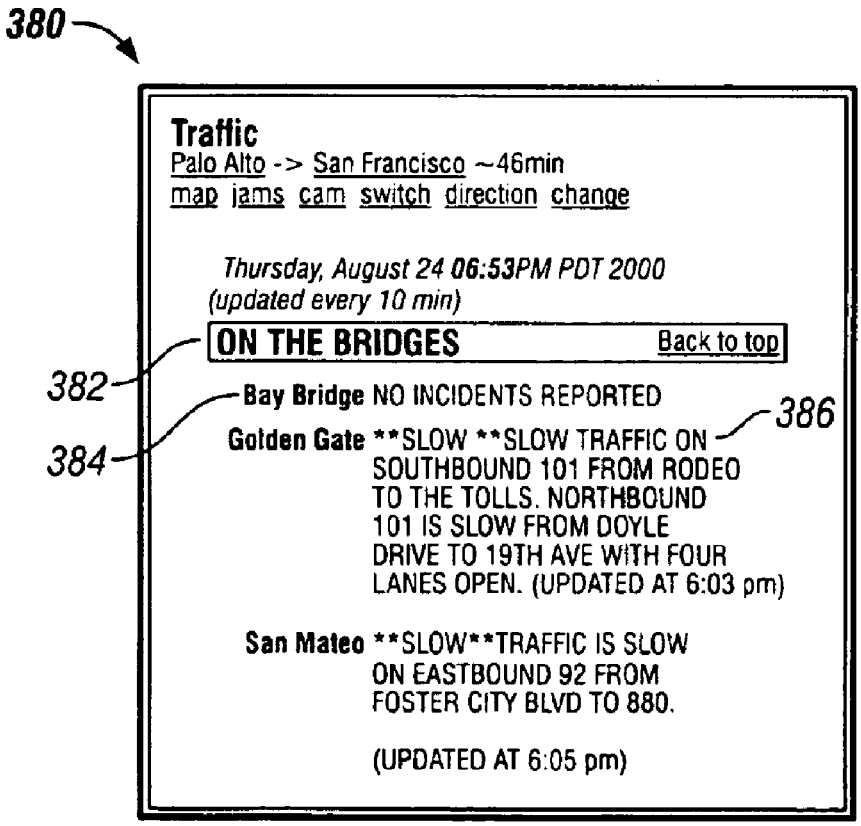

FIG. 3F illustrates an implementation of an all-incident display 380 that may be provided by the traffic monitoring system in response to the user selecting the incident icon 348. The all-incident display 380 may be subdivided into incident categories 382 including "bridges," "tunnels," "interstates and intrastate highways," or "side streets." Location-names 384 associated with the incident category may be provided by the system. The system also may provide a narrative description 386 for each of the location-names 384.

Figure 3G:
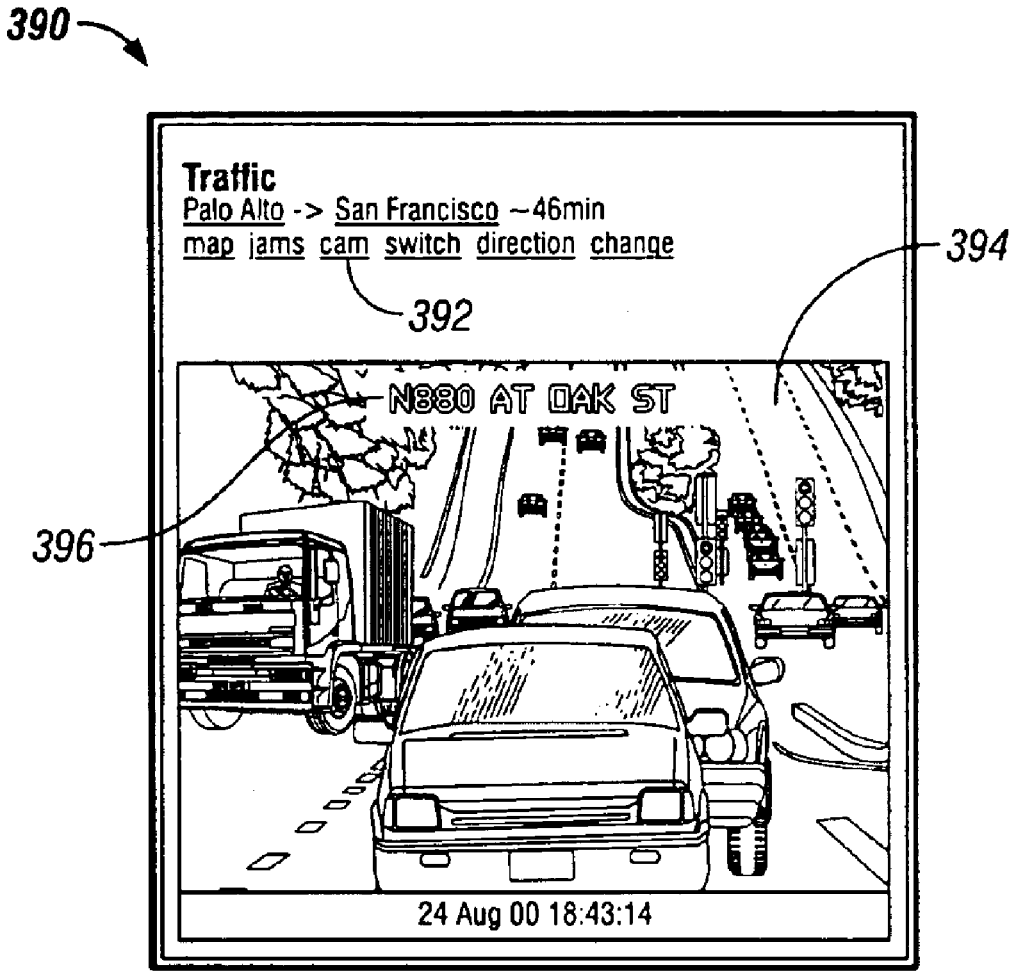

FIG. 3G illustrates an implementation of a traffic camera view 390 of a traffic incident that may be provided by the traffic monitoring system in response to the user selecting a camera view button 392 from the display menu. The system may provide a real-time or delayed camera view 394 of portions of the traffic route. The camera view 394 also may include a location indication 396 indicative of the route portion presented.

Figure 3H:
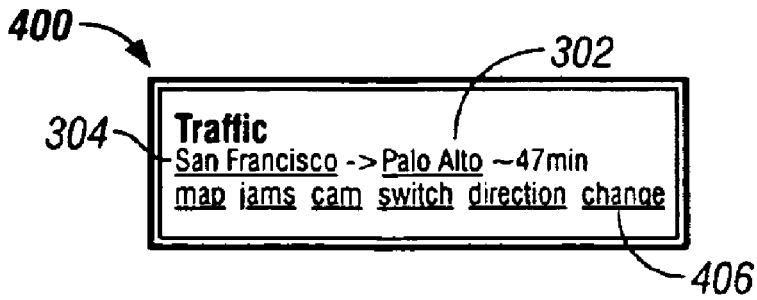

FIG. 3H illustrates a portion of a display 400. In response to a user selection of change direction button 406 from the menu, the system interchanges the starting location 302 with the destination location 304 for providing the user with information on a return trip.

Figure 3I:
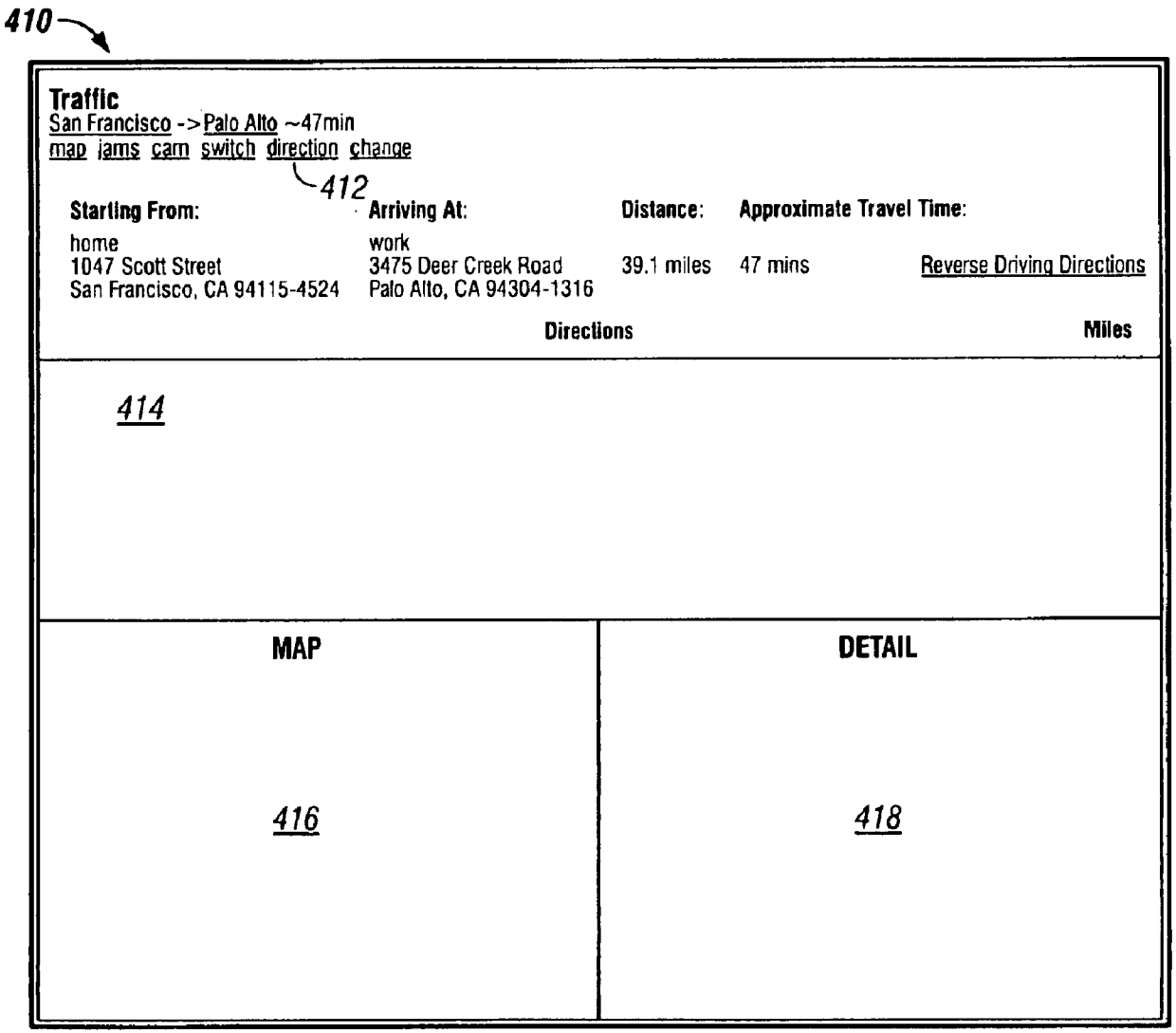

FIG. 3I illustrates an implementation of a direction display 410 that the traffic monitoring system may display in response to a user selection of a direction button 412 from the menu. The display 410 may present driving instructions 414 for navigating from the starting location to the destination location along with as a map 416 of the route and a detailed map 418 of the route in a close proximity to the starting or destination location.

In one implementation, traffic flow conditions may be monitored by monitoring cellular phone transmitters to determine the time for mobile traffic to move from one transmitter to another. Because the distance between transmitters is known and the location of the transmitters relative to vehicle traffic routes, the rate of movement of vehicular traffic along portions of a route may be calculated. Delay portions of the route may be determined by comparing the speed of vehicles along the route with predetermined speed of vehicles on that portion. A delayed portion is deemed to be a portion of the route where the calculated speed of vehicular traffic is less than a predetermined speed.

Figure 4:
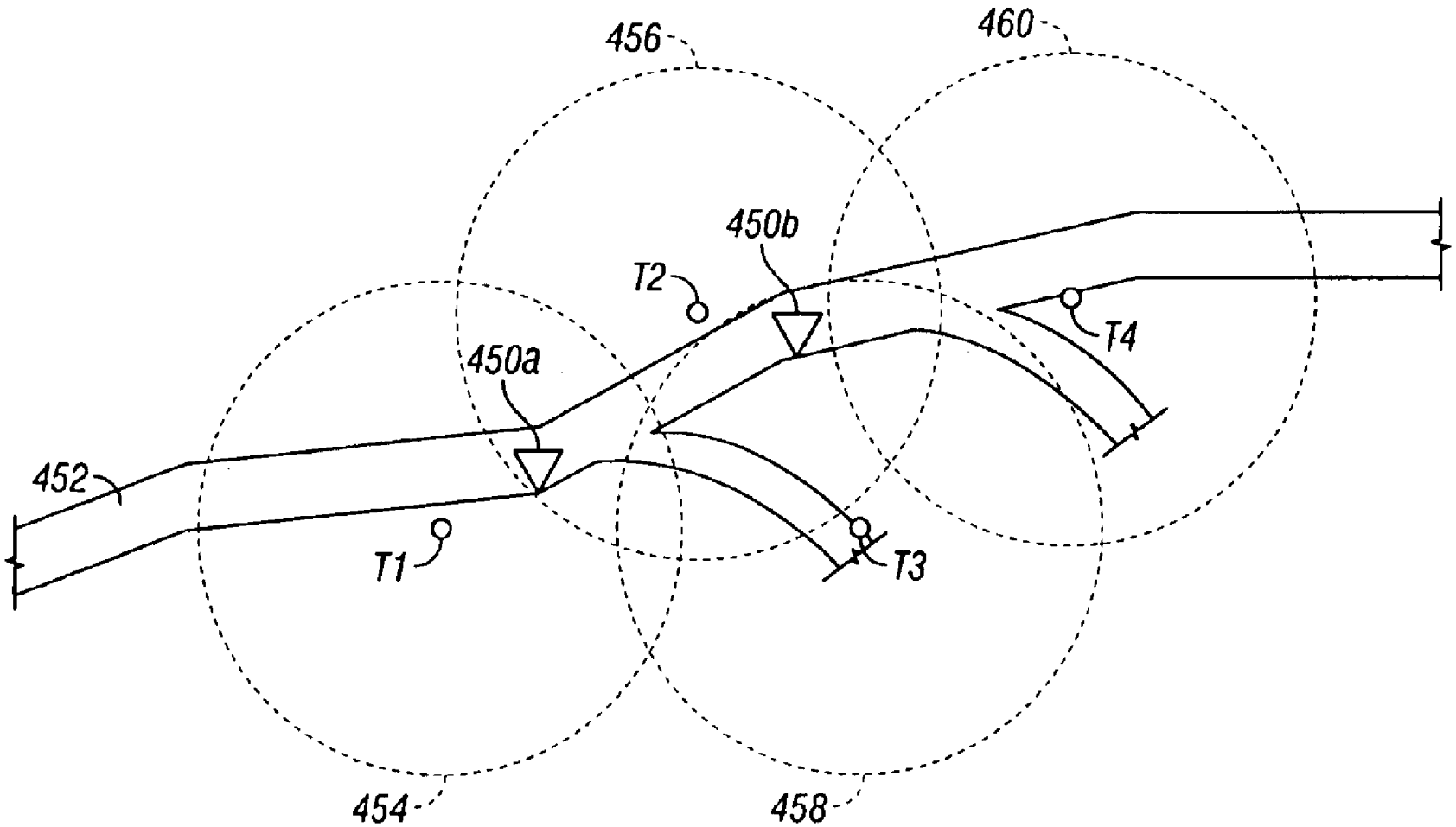
FIG. 4 is an example of wireless receiver reception areas covering a traffic route.

FIG. 4 illustrates a relationship between wireless devices being used in a vehicle 450 traveling along a route 452 and receiving towers T1 to T4. Each of the receiving towers T1 to T4 may receive signal transmitted from within an area bounded by the peripheries 454 to 460, respectively. As the vehicle progresses from a first location 450*a* to a second location 450*b*, one or more of the receivers T1 to T4 may receive a transmitted signal from the vehicle. For example, when the vehicle is at first location 450*a*, a transmitted signal may be received by receivers T1 and T2. If the vehicle is at second location 450*b*, a transmitted signal may be received by receivers T2 and T3.

Figure 5:
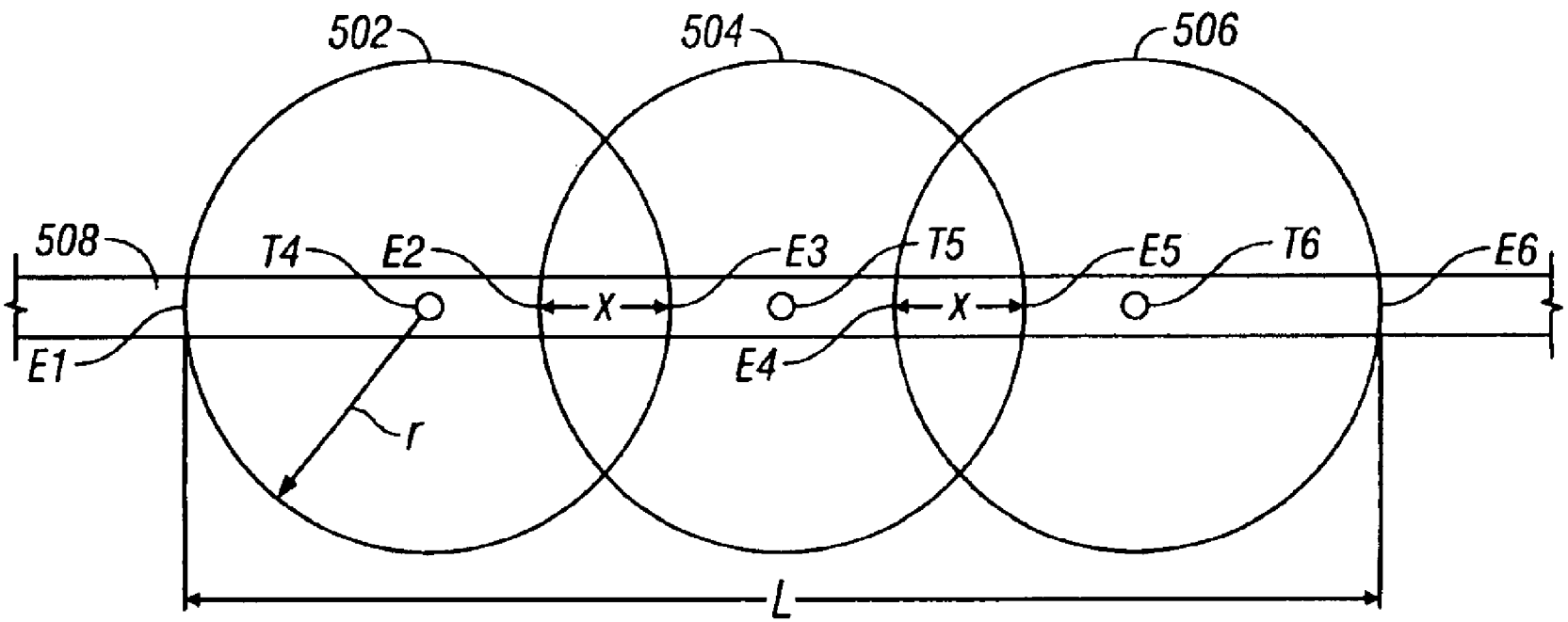
FIG. 5 is an example of a method for calculating the speed of a vehicle using signals received from wireless transmitters in the vehicle.

FIG. 5 illustrates an arrangement where a signal from a transmitting wireless device in a vehicle may be used to determine a speed that the vehicle travels through wireless device reception areas 502, 504 and 506 that are serviced by receivers T5, T6 and T7, respectively. In this example, the speed of traffic may be calculated for a wireless device transmitting a signal that may be received by receivers T5–T7. Each receiver can pick up signals transmitted from the wireless transmitter that is within a radius, r, of the receiver. In this example, assume that an overlap in the reception area 502 with 504 and reception area 504 with 506 both are equal to a known distance, x. A vehicle having a transmitting wireless device may be located at any position such as E1–E6 along a highway 508. The length, L, is the distance between E1 and E6 and represents the total distance along a highway 508 covered by the reception areas 502, 504 and 506.

The signal strength received by receivers T5–T7 from transmitting wireless devices within the respective ranges 502–506 may be measured at known intervals, t, and recorded. After a predetermined period of time, P, a matrix may be developed that includes identification of a transmitting wireless device, the receiver T5–T7 that received the transmitted signal and the time the signal was received. FIG. 6 is a sample matrix 600 including illustrative entries for wireless device identification 602, receivers T5–T7 604–608 and a time 610, for example, that a signal from the transmitter was received.

Figure 7:
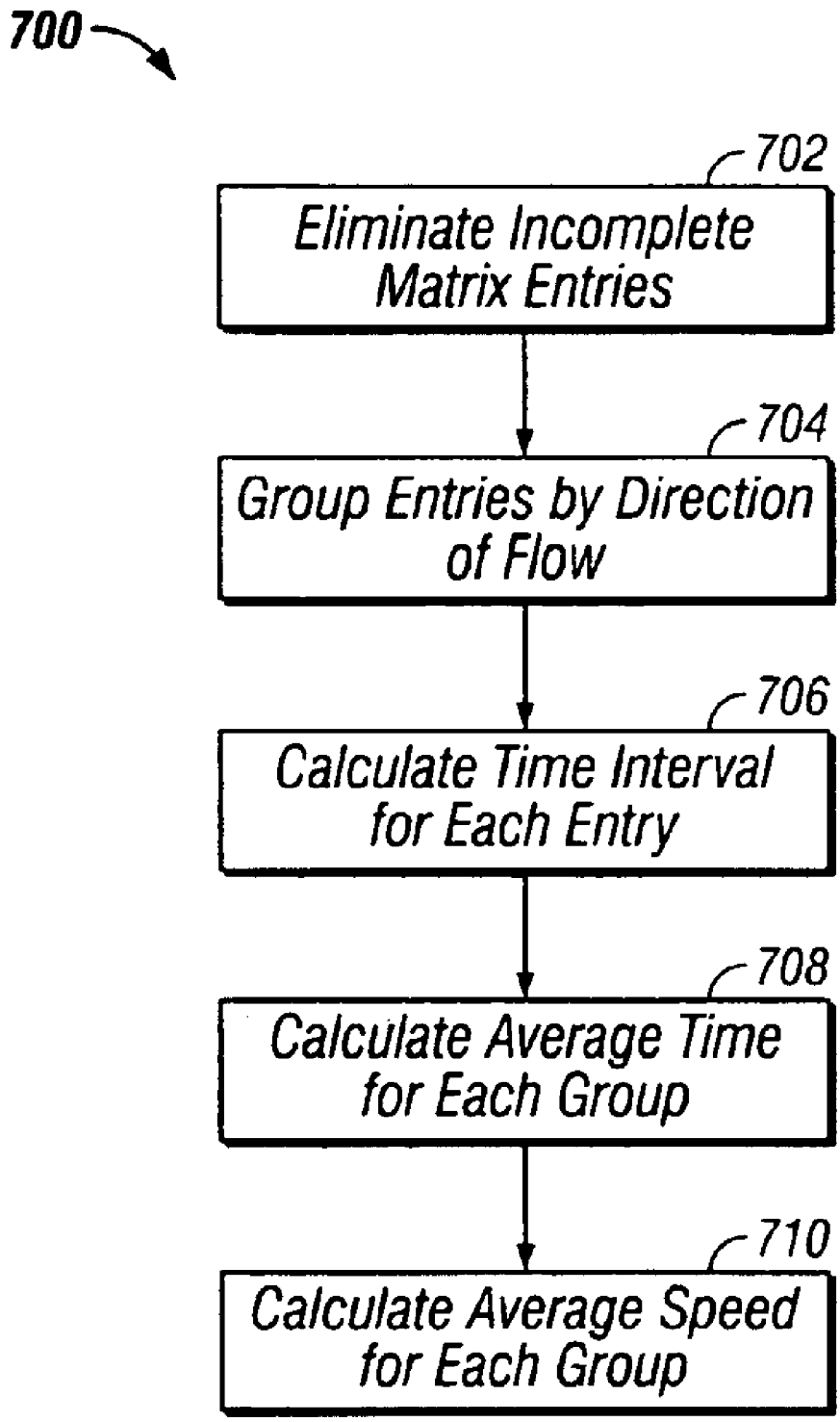
FIG. 7 is a flow chart of a process for calculating an average speed of vehicles from the entries in the matrix of FIG. 6.

FIG. 7 is a flow chart 700 illustrating a method by which the data of the matrix 600 may be analyzed to estimate the speed of traffic flow in a portion of the route by:

a. Eliminating 702 matrix entries for an identified transmitting wireless device where there is no corresponding time received for each receiver T5–T7 within the time period, P. In the example matrix of FIG. 6, entries for transmitters 06 and 08 are eliminated from the calculation because an entry was not recorded by at least one of the receivers during the period;

b. Grouping 704 the remaining matrix entries into two groups, G1 and G2, where the entries in G1 include those entries where the signal is received by T5 then T6 then T7 and G2 includes those entries where the signal is received by T7 then T6 then T5. G1 entries are those entries where the transmitting wireless device is traveling in one direction along route 508 and G2 are those transmitting wireless device traveling in an opposite direction. In FIG. 6, G1 includes the time entries for transmitters 01, 02, 04 and 07 and G2 includes the time entries for transmitters 03 and 05;

c. Calculating 706 a time Ti as an interval from the first reading of T5 until the last reading of T7 for each entry in Group G1 and calculating a time Tj as an interval from the first reading of T7 until the last reading of T5 for each entry in G2. For additional accuracy of time intervals, one time interval may be added for the full length of the reading. For G1 of the example, the time intervals for transmitters 01, 02, 04 and 07 are 191 seconds, 204 seconds, 190 seconds and 200 seconds, respectively;

d. Calculating 708 the average Ti, TiAv for Group G1 as a sum of all calculated Ti for each G1 entry divided by the number of entries in G1 and calculating the average Tj, TjAv for Group G2 as a sum of all calculated Tj for each G2 entry divided by the number of entries in G2. The average interval in the example is (191+204+190+200)/4=196.25 seconds or 196.25/60=3.271 minutes; and e. Calculating 710 an average speed (SPG1) of vehicles having transmitting wireless devices as:

$$SPG1 = \frac{L*60}{TiAv} \text{ miles per hour}$$

If the distance, L, in the example is 3 miles then the average rate of the vehicles may be calculated as: (3*60)/3.271=55 mph.

A similar calculation may be used to determine an average speed (SPG2) of vehicles traveling in the opposite direction from G1 and having transmitting wireless devices.

As data are collected for transmitting devices over time, the traffic monitoring system may recognize wireless devices traveling through the network and, with some pattern recognition, get the relevant wireless devices traveling on a particular highway in a particular direction and can calculate their speed of travel. For example, if the system has tracked a wireless device that travels through the system as described above, a pattern may develop. At a first time, a first registration at the receivers in towers T5 and T6 with signal strength S5 and S6, respectively, may be determined. At a second time, receivers in towers T5 and T6 are registering signal strength S5' and S6', respectively. The system may then calculate which route the transmitting device was traveling along. The pattern of receiver and received signal strength becomes a pattern that the system may use to compare to new incoming signals. Hence, the system may receive two signal strength readings from the towers T5 and T6, respectively, within a time interval and compare that with the available patterns and determine relevant received signal patterns from irrelevant patterns.

Alternatively, vehicle traffic information may be obtained by making use of traffic sensors as are found at bridges in some areas of Europe to monitor vehicle volume. These may provide traffic volume information and provide an indication of the likelihood of a traffic delay portion on a route. The disclosed system may include speed sensors incorporated at various locations along a route to monitor traffic speed. The system also may include cameras to gather visual traffic information at selected route locations. In response to a user request, the system also may be enabled to provide an alternative route and an estimated travel time from a selected starting location to a selected destination location.

Test cars equipped with global positioning system (GPS) wireless devices may be used to establish predetermined speeds of travel along different route portions. The traffic monitoring system also may be used to track commuter trains, their exact position, and determine whether their arrival will be on time or delayed.

The system and techniques can be implemented in digital electronic circuitry, or in computer hardware, firmware, software, or in combinations of them. The system and techniques can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the system and techniques can be performed by one or more programmable processors executing a computer program to perform functions of the system and techniques by operating on input data and generating output. Method steps can also be performed by, and apparatus of the system and techniques can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks such as internal hard disks and removable disks; magneto-optical disks; and CD-ROM and DVD-ROM disks. The processor and the memory can be supplemented by, or incorporated in special purpose logic circuitry.

To provide for interaction with a user, the system and techniques can be implemented on a computer having a display device such as a CRT (cathode ray tube) or LCD (liquid crystal display) monitor for displaying information to the user and a keyboard and a pointing device such as a mouse or a trackball by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

The system and techniques can be implemented in a computing system that includes a back-end component, e.g., as a data server, or that includes a middleware component, e.g., an application server, or that includes a front-end component, e.g., a client computer having a graphical user interface or an Web browser through which a user can interact with an implementation of the system and techniques, or any combination of such back-end, middleware, or front-end components. The components of the system can be interconnected by any form or medium of digital data communication, e.g., a communication network. Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

Other embodiments are within the scope of the following claims.

What is claimed is:

1. A method comprising:

determining a primary route from a starting location to a destination location;

determining an average speed of vehicles along portions of the primary route from signals received from wireless transmitters transmitting from the vehicles, wherein determining an average speed of vehicles along portions of the primary route comprises determining a speed for at least one of the vehicles based on signals indicative of the presence of the vehicle within multiple reception areas;

identifying one or more delayed portions of the primary route at which the average speed is less than a respective predetermined speed; and displaying the primary route including indicia of the one or more identified delayed portions.

2. The method of claim 1, wherein identifying a delayed portion comprises:

determining an initial time when a signal from each of a plurality of transmitters transmitting from vehicles traveling along the primary route is received by a first receiver having a known reception area;

determining a final time when each of transmitters is no longer received by the first receiver;

calculating the speed of each of the transmitters through the first reception area;

combining the speeds of all transmitters in the series; and determining a delayed portion based upon a comparison of the combined speed with a predetermined speed.

3. The method of claim 1, further comprising:

iteratively identifying at predetermined intervals one or more delayed portions of the primary route at which the average speed is less than the respective predetermined speed; and displaying the primary route including indicia of the one or more identified delayed portions.

4. The method of claim 1, further comprising enabling a user to select the starting location and the destination location.

5. The method of claim 1, further comprising providing at least one alternative route from the starting location to the destination location.

6. The method of claim 5, further comprising enabling a user to select a primary route or an alternative route as a selected route.

7. The method of claim 1, further comprising providing a link from the indicia to the network resource identifying the delayed portion.

8. The method of claim 1 further comprising providing a link to a display of information describing instructions for traveling the primary route.

9. The method of claim 1 wherein the selected starting location or the destination location has a default value selectable by the user.

10. The method of claim 9 wherein the starting location is determined from a signal received from a global positioning system associated with the user's wireless transmitter.

11. The method of claim 1, further comprising providing a menu of options the options linked to network resources to provide information including at least one of map to display a map of the route from the starting location to the destination location, camera to display a camera view of a delayed portion, jams to display a listing of delayed portions on the primary route, switch to interchange the starting and destination locations, directions to provide a textual listing of driving instruction from the stating location to the destination location and change to enable a user to enter a default starting location or a default destination location.

12. A method comprising:

transmitting a starting location and a destination location to a server;

receiving a primary route from the starting location to the destination location including indicia at each portion of the route at which vehicle speed in each delayed portion is less than a respective expected value and wherein the vehicle speed is determined from signals received from wireless transmitters transmitting from vehicles traveling along the primary route, the signals being indicative of the presence of the vehicles in multiple reception areas; and displaying the primary route and indicia.

13. The method of claim 12 wherein the transmitting is accomplished by a wireless transmitting device.

14. The method of claim 13 wherein the starting location is determined from a signal received from a global positioning system associated with the wireless transmitting device.

15. The method of claim 14 wherein the wireless device includes a cellular phone and a personal digital assistant.

16. The method of claim 13 wherein the route and indicia are displayed on a wireless device.

17. The method of claim 13, further comprising receiving at least one alternative route from the starting location to the destination location.

18. The method of claim 13, wherein each indicium provides a link to a network resource identifying the delayed portion.

19. The method of claim 13 further comprising receiving a display of information describing instructions for traveling the primary route.

20. The method of claim 13, further comprising receiving a menu of options the options linked to network resources to provide information including at least one of map to display a map of the route from the starting location to the destination location, camera to display a camera view of a delayed portion, jams to display a listing of delayed portions on the primary route, switch to interchange the starting and destination locations, directions to provide a textual listing of driving instruction from the stating location to the destination location and change to enable a user to enter a default starting location or a default destination location.

21. A method comprising:

determining a first location of a wireless transmitter transmitting from a vehicle traveling along a route relative to a first receiver at a first time based on a first signal received from the transmitter, the first location being within a first reception area;

determining a second location of the transmitter relative to the first receiver at a second time based on a second signal received from the transmitter, the second location being within a second reception area;

calculating a distance between the first and second locations based on information related to the first and second reception areas; and calculating a speed of movement the transmitter.

22. The method of claim 21, further comprising comparing the calculated speed to a predetermined speed.

23. A method comprising:

determining an initial time when a signal from each of a plurality of transmitters transmitting from vehicles traveling along a route is received by a first receiver having a known reception area;

determining a final time when each transmitter is no longer received by the first receiver;

calculating a time interval for each transmitter to travel through the first reception area;

calculating an average time for all transmitters to travel through the reception area; and calculating an average speed of the transmitters traveling through the first reception area.

24. The method of claim 23, further comprising comparing the average speed to a predetermined speed.

25. A method comprising:

associating each of a plurality of transmitting devices transmitting from vehicles traveling along a route with a time when a signal from each transmitting device is received by each of a plurality of receivers in a predetermined time period;

eliminating the associations where there is no corresponding time associated with each receiver;

calculating an interval time from an earliest time to a latest time associated with each transmitter;

calculating an average interval time, TiAv, for all transmitters; and calculating an average speed, SPG1, of movement the transmitters as:

$$SPG1 = \frac{L * 60}{TiAv} \text{ miles per hour}$$

wherein L is a distance of a transmitter location from a nearest receiver when an earliest signal is received by one of the receivers to a transmitter location when from a nearest receiver when a latest signal is received from the transmitter.

26. The method of claim 25, further comprising comparing the average speed to a predetermined speed.

27. An article comprising a machine-readable medium storing instructions operable to cause one or more machines to perform operations comprising:

determining a primary route from a starting location to a destination location;

determining an average speed of vehicles along portions of the primary route from signals received from wireless transmitters transmitting from the vehicles, wherein determining an average speed of vehicles along portions of the primary route comprises determining a speed for at least one of the vehicles based on signals indicative of the presence of the vehicle within multiple reception areas;

identifying one or more delayed portions of the primary route at which the average speed is less than a respective predetermined speed; and displaying the primary route including indicia of the one or more identified delayed portions.

28. The article of claim 27, wherein identifying a delayed portion comprises storing instructions operable to cause the one or more machines to perform operations comprising:

determining an initial time when a signal from each of a plurality of transmitters transmitting from vehicles traveling along the primary route is received by a first receiver having a known reception area;

determining a final time when each of transmitters is no longer received by the first receiver;

calculating the speed of each of the transmitters through the first reception area;

combining the speeds of all transmitters in the series; and determining a delayed portion based upon a comparison of the combined speed with a predetermined speed.

29. The article of claim 27, further comprising storing instructions operable to cause the one or more machines to perform operations comprising providing at least one alternative route from the starting location to the destination location.

30. The article of claim 29, further comprising enabling a user to select a primary route or an alternative route as a selected route.

31. An article comprising a machine-readable medium storing instructions operable to cause one or more machines to perform operations comprising:

transmitting a starting location and a destination location to a server;

receiving a primary route from the starting location to the destination location including indicia at each portion of the route at which vehicle speed in each delayed portion is less than a respective expected value and wherein the vehicle speed is determined from signals received from wireless transmitters transmitting from vehicles traveling along the primary route, the signals being indicative of the presence of the vehicles in multiple reception areas; and displaying the primary route and indicia.

32. The article of claim 31 wherein the route and indicia are displayed on a wireless device.

33. The article of claim 31, further comprising receiving at least one alternative route from the starting location to the destination location.

34. An article comprising a machine-readable medium storing instructions operable to cause one or more machines to perform operations comprising:

determining a first location of a wireless transmitter transmitting from a vehicle traveling along a route relative to a first receiver at a first time based on a first signal received from the transmitter, the first location being within a first reception area;

determining a second location of the transmitter relative to the first receiver at a second time based on a second signal received from the transmitter, a second location being within the second reception area;

calculating a distance between the first and second locations based on information related to the first and second reception areas; and calculating a speed of movement the transmitter.

35. The article of claim 34, further comprising storing instructions operable to cause the one or more machines to perform operations comprising comparing the calculated speed to a predetermined speed.

36. An article comprising a machine-readable medium storing instructions operable to cause one or more machines to perform operations comprising:

determining an initial time when a signal from each of a plurality of transmitters transmitting from vehicles traveling along a route is received by a first receiver having a known reception area;

determining a final time when each transmitter is no longer received by the first receiver;

calculating a time interval for each transmitter to travel through the first reception area;

calculating an average time for all transmitters to travel through the reception area; and calculating an average speed of the transmitters traveling through the first reception area.

37. The article of claim 36, further comprising storing instructions operable to cause one or more machines to perform operations comprising comparing the average speed to a predetermined speed.

38. An article comprising a machine-readable medium storing instructions operable to cause one or more machines to perform operations comprising:

associating each of a plurality of transmitting devices transmitting from vehicles traveling along a route with a time when a signal from each transmitting device is received by each of a plurality of receivers in a predetermined time period;

eliminating the associations where there is no corresponding time associated with each receiver;

calculating an interval time from an earliest time to a latest time associated with each transmitter;

calculating an average interval time, TiAv, for all transmitters; and calculating an average speed, SPG1, of movement the transmitters as:

$$SPG1 = \frac{L * 60}{TiAv} \text{ miles per hour}$$

wherein L is a distance of a transmitter location from a nearest receiver when an earliest signal is received by one of the receivers to a transmitter location when from a nearest receiver when a latest signal is received from the transmitter.

39. The article of claim 38, further comprising comparing the average speed to a predetermined speed.

40. A system comprising one or more computers configured to:

determine a primary route from a starting location to a destination location;

determine an average speed of vehicles along portions of the primary route from signals received from wireless transmitters transmitting from the vehicles, wherein the system configured to determine an average speed of vehicles along portions of the primary route comprises the system configured to determine a speed for at least one of the vehicles based on signals indicative of the presence of the vehicle within multiple reception areas;

identify one or more delayed portions of the primary route at which the average speed is less than a respective predetermined speed; and display the primary route including indicia of the one or more identified delayed portions.

41. The system of claim 40, wherein the delayed portion is identified by the computers are configured:

determine an initial time when a signal from each of a plurality of transmitters transmitting from vehicles traveling along the primary route is received by a first receiver having a known reception area;

determine a final time when each of transmitters is no longer received by the first receiver;

calculate the speed of each of the transmitters through the first reception area;

combine the speeds of all transmitters in the series; and determine a delayed portion based upon a comparison of the combined speed with a predetermined speed.

42. The system of claim 41, further comprising the computers configured to provide at least one alternative route from the starting location to the destination location.

43. The system of claim 42, further comprising the computers configured to enable a user to select a primary route or an alternative route as a selected route.

44. A system comprising one or more computers configured to:

transmit a starting location and a destination location to a server;

receive a primary route from the starting location to the destination location including indicia at each portion of the route at which vehicle speed in each delayed portion is less than a respective expected value and wherein the vehicle speed is determined from signals received from wireless transmitters transmitting from vehicles traveling along the primary route, the signals being indicative of the presence of the vehicle in multiple reception areas; and display the primary route and indicia.

45. The system of claim 44 wherein the route and indicia are displayed on a wireless device.

46. The system of claim 45, further comprising the computers configured to receive at least one alternative route from the starting location to the destination location.

47. A system comprising one or more computers configured to:

determine a first location of a wireless transmitter transmitting from a vehicle traveling along a route relative to a first receiver at a first time based on a first signal received from the transmitter, the first location being within a first reception area;

determine a second location of the transmitter relative to the first receiver at a second time based on a second signal received from the transmitter, the second location being within a second reception areas;

calculate a distance between the first and second locations based on information related to the first and second reception areas; and calculate a speed of the transmitter.

48. The system of claim 47, further comprising the computer configured to compare the calculated speed to a predetermined speed.

49. A system comprising one or more computers configured to:

determine an initial time when a signal from each of a plurality of transmitters transmitting from vehicles traveling along a route is received by a first receiver having a known reception area;

determine a final time when each transmitter is no longer received by the first receiver;

calculate a time interval for each transmitter to travel through the first reception area;

calculate an average time for all transmitters to travel through the reception area; and calculate an average speed of the transmitters traveling through the first reception area.

50. The system of claim 49, further comprising the computers configured to compare the average speed to a predetermined speed.

51. A system comprising one or more computers configured to:

associate each of a plurality of transmitting devices transmitting from vehicles traveling along a route with a time when a signal from each transmitting device is received by each of a plurality of receivers in a predetermined time period;

eliminate the associations where there is no corresponding time associated with each receiver;

calculate an interval time from an earliest time to a latest time associated with each transmitter;

calculate an average interval time, TiAv, for all transmitters; and calculate an average speed, SPG1, of the transmitters as:

$$SPG1 = \frac{L*60}{TiAv} \text{ miles per hour}$$

wherein L is a distance of a transmitter location from a nearest receiver when an earliest signal is received by one of the receivers to a transmitter location when from a nearest receiver when a latest signal is received from the transmitter.

52. The system of claim 51, further comprising the computers configure to compare the average speed to a predetermined speed.

* * * * *